US005478185A

United States Patent [19]

Kranz

[11] Patent Number: 5,478,185

[45] Date of Patent: Dec. 26, 1995

[54] BULK ENVELOPE CONTAINER AND TRANSFER SYSTEM AND METHOD

[75] Inventor: Richard Kranz, Leawood, Kans.

[73] Assignee: Tension Envelope Corporation, Kansas City, Mo.

[21] Appl. No.: 172,758

[22] Filed: Dec. 27, 1993

[51] Int. Cl.[6] ..... B65G 1/06

[52] U.S. Cl. ..... 414/331; 414/222; 414/269; 414/609; 414/417; 221/112

[58] Field of Search ..... 414/222, 268–270, 414/277, 280, 331, 609, 659, 417; 221/87, 103, 112; 220/503–504, 524

[56] References Cited

U.S. PATENT DOCUMENTS

| | | | |
|---|---|---|---|
| 3,624,792 | 11/1971 | Lipfert | 221/129 |
| 3,868,044 | 2/1975 | Abe et al. | 271/9 X |
| 3,877,607 | 4/1975 | Long | 221/112 X |
| 3,915,338 | 10/1975 | Kronseder et al. | 221/1 |
| 3,921,828 | 11/1975 | Suizu | 414/280 |
| 3,986,614 | 10/1976 | Fernandez-Rana et al. | 414/609 X |
| 4,016,986 | 4/1977 | Thomas | 414/269 X |
| 4,036,381 | 7/1977 | Nielsen et al. | 414/222 X |
| 4,369,089 | 1/1983 | Mohn et al. | 271/9 X |
| 4,451,191 | 5/1984 | Torre | 271/9 X |
| 4,625,641 | 12/1986 | Jagosz et al. | 271/9 X |
| 4,669,047 | 5/1987 | Chucta | 414/331 X |
| 4,701,097 | 10/1987 | Sturtz | 414/659 X |
| 4,770,591 | 9/1988 | Wright et al. | 414/331 |
| 5,002,267 | 3/1991 | Brecy | 271/9 |
| 5,064,330 | 11/1991 | Kumagai | 414/331 |
| 5,167,408 | 12/1992 | Golicz | 271/149 |

FOREIGN PATENT DOCUMENTS

| | | | |
|---|---|---|---|
| 0205390 | 12/1986 | European Pat. Off. | 414/331 |
| 3721905 | 1/1988 | Germany | 221/87 |
| 2197299 | 5/1988 | United Kingdom | 414/331 |

*Primary Examiner*—Michael S. Huppert
*Assistant Examiner*—James W. Keenan
*Attorney, Agent, or Firm*—Litman, McMahon and Brown

[57] ABSTRACT

A bulk envelope container for use in a bulk envelope transfer system and method includes a plurality of elongate chambers, each of which can store a stack of envelopes. The chambers can be arranged in rows and columns and the container is designed for use with a positioning table which is movable both horizontally and vertically to selectively align one of the chambers with a loading or unloading device. Each chamber has attached thereto a motorized gate which can be opened when the chamber is aligned for loading or unloading and closed when the associated chamber is not so aligned. An exemplary loading and unloading apparatus and a synchronizing control system is disclosed for use with the container and positioning table.

23 Claims, 5 Drawing Sheets

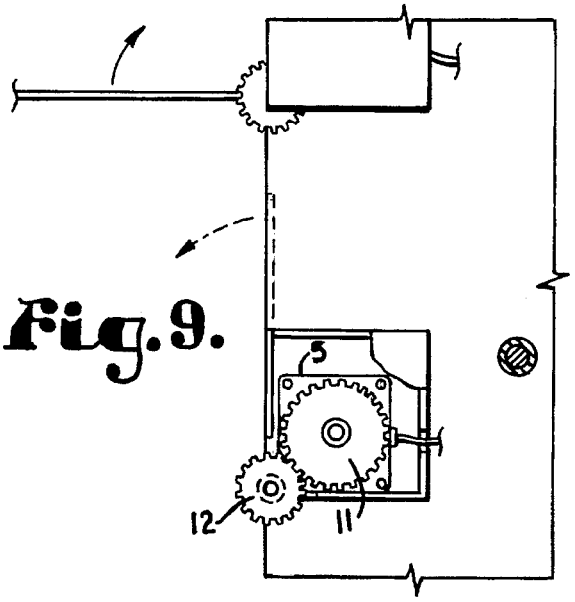
Fig. 9.
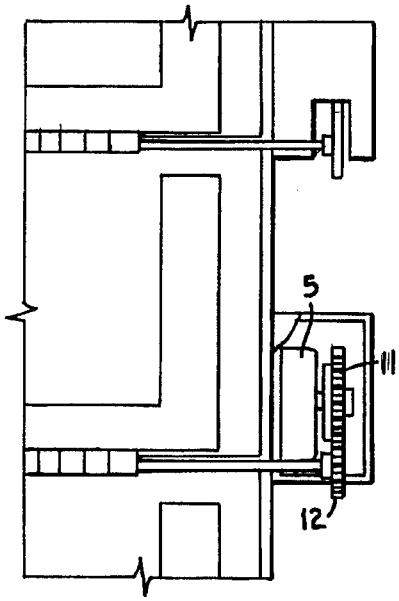
Fig. 10.
Fig. 11.
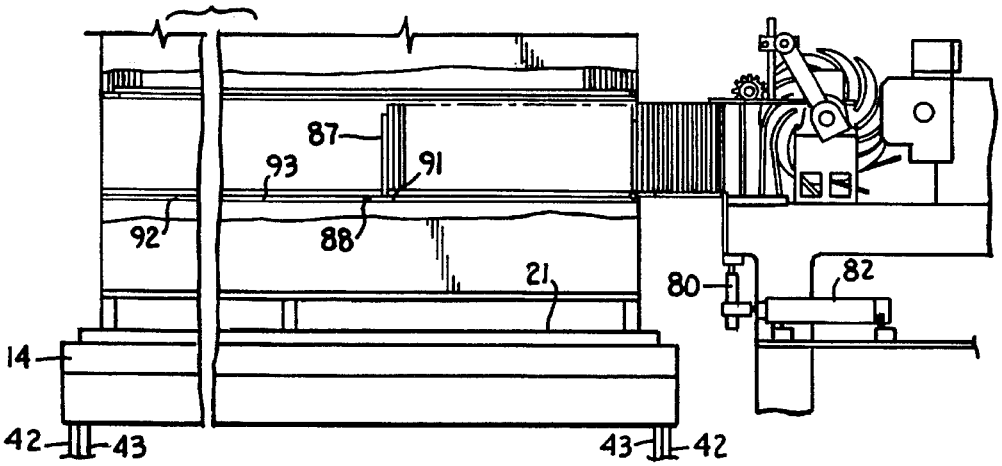
Fig. 12.
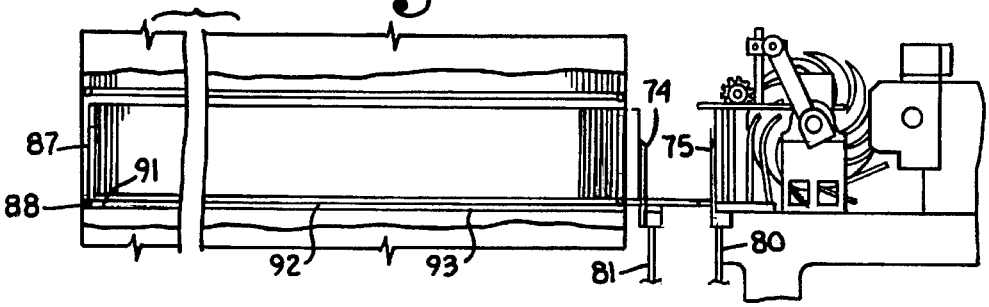

BULK ENVELOPE CONTAINER AND TRANSFER SYSTEM AND METHOD

BACKGROUND OF THE INVENTION

1. Field of the Invention

The present invention relates to a bulk envelope transfer container, and, more particularly, to such a container which includes a plurality of elongate envelope receiving chambers. Each chamber includes an electromechanically controllable gate mechanism at one end thereof. The gate mechanisms are controllable such that the gate of a selected chamber can be lowered and envelopes loaded from an envelope manufacturing machine or the like, with the gate then being raised to a closed position to hold the loaded envelopes in the chamber. During such loading, the container is placed on a positioning table which is selectively operable to move the container vertically and horizontally to align specific ones of said chambers with a loading surface of the envelope manufacturing machine. For unloading, the positioning table can be used to selectively position each chamber in alignment with an envelope hopper for an automatic letter stuffer or the like.

2. Description of the Related Art

Envelope manufacturing in general has increasingly become a highly automated operation. In the production of standard and specialty envelopes, large, complex machines serve to fold blanks, apply patches, and place adhesive on the side and top or seal flaps. The side flaps are folded over and sealed and the finished envelopes are normally output via a delivery spider into a horizontal stack onto a delivery surface to be accumulated into stacks of envelopes, generally containing from 500 to 2000 envelopes. The stacks are accumulated and transferred for other operations, such as loading into cartons.

In the past, once they were machine delivered onto the loading surface, these horizontal stacks of envelopes were further manipulated one by one, often by hand, for further processing and/or for loading into boxes for shipment to a customer. In the case of specialty envelopes for bulk mailing customers, the boxes of envelopes would then be unloaded by hand at the customer's place of business and placed into automatic equipment such as letter stuffers and the like.

Modern stuffing machines are capable of operation speeds reaching or exceeding 15,000 envelopes per hour. At these speeds, it takes a full time employee to keep an stuffing machine feed hopper full by manually removing envelopes from shipping cartons and placing them in stacks on the feed hopper.

Thus, there are often many thousands of specialty envelopes in a single shipment to a customer, with each stack of envelopes in the shipment requiring manual loading into a carton, the cartons being loaded into crates and shipped. At the customer end, the crates are then manually unpacked, the individual cartons removed, opened, and the envelopes loaded into stuffer feed hoppers by hand.

There are a number of problems inherent in this repetitive use of manual labor for processing bulk specialty envelopes. First, the use of manual labor is expensive, when compared to automated equipment. In the case of automatic stuffers, if envelopes were not required to be loaded by hand, a single worker could service several machines, instead of having one worker per machine, as is the current custom. Second, the workers themselves face a problem in handling the envelope stacks, i.e., once they are picked up by compressing the stacks inwardly from the ends, the envelopes tend to spring outward, often causing envelopes to loosen and drop out, thus causing the stacks to fall apart. This means that the workers must manually exert a considerable compensating force inward against the bottom edges of the envelope stack, effectively squeezing the stack bottom to prevent the stacks from falling apart as they are lifted. Even with these precautions, it is all too common for envelope stacks to be dropped, with resulting waste and inefficiency at both the manufacturing and the end processing facilities.

Finally, the handling of the stacks leads to the third problem, which is that these repetitious manual lifting, squeezing and turning motions, when repeated hour after hour and day after day, frequently cause the affected workers to develop carpal tunnel syndrome. This is an extremely painful nerve, muscle and ligament irritation in the wrists and hands which can cause temporary and even permanent disability in the workers. In addition to the problem of the resulting pain and suffering, these injuries represent a considerable financial strain in the form of workmen's compensation, lost wages, sick leave, etc. to an envelope manufacturer, and, conceivably, even to a large volume bulk mailing facility.

It is clear then, that a need exists for an automated system and method for loading and transferring bulk envelopes from a manufacturing facility to a bulk mailer or other end user, which may be an operation in the same facility. Such a system should be capable of reliably loading multiple horizontal stacks of envelopes into a bulk container, securing the envelopes in the container, transferring the bulk container to the end user, whether in the same plant as the manufacturer or in a distant facility, and allowing the end user to use automated equipment to offload the envelopes from the container.

SUMMARY OF THE INVENTION

The present invention is directed to an bulk envelope container and transfer system and method. The container has a number of elongate chambers, which may be arranged in rows and columns. The container is positionable on a positioning table which is capable of moving the container vertically and horizontally to align different chambers with a loading surface at an envelope manufacturing machine or the like.

As the envelopes are output from the manufacturing machine onto the loading surface, accumulation and batching is accomplished, for example, via a loading apparatus including first and second movable vertically oriented blade supports, which accumulate and load stacks of the envelopes into the container. When a predetermined number of envelopes have been deposited onto the surface, as determined by a counter, they are propelled into a waiting chamber of the bulk container. The accumulating and loading steps are repeated until the chamber is filled.

Meanwhile, within the container, a horizontally movable spring loaded vertically oriented support can be positioned in each chamber to support the envelopes as they are forced into the aligned chamber by the loading apparatus, the support being pushed backwards as the envelopes accumulate in the chamber. When the aligned chamber is full, an electromechanically controlled gate is closed and the positioning table is operated to move the container to align the next empty chamber with the loading surface as its gate is opened.

The chambers can be aligned with the loading surface, for example, via a timing and logic circuit which selectively causes the positioning table to move the container horizontally via a roller conveyor driven by a reversible conveyor motor and/or vertically via a vertical adjustment actuator to a position in which the next chamber is aligned with the loading surface. The logic circuit controls a switch to shut off the conveyor motor when the correct chamber and the spring detent are aligned. The logic circuit can also control gate activation in the aligned chamber, i.e. the gate in the aligned chamber is lowered when the associated switch is operated. When an entire row of chambers has been filled, the positioning table is raised (or lowered) to align the next row of chambers with the loading surface and the accumulating and loading steps and the horizontal adjustment are repeated. Raising and lowering of the positioning table is accomplished via a scissors jack, which can be operated pneumatically or electromechanically. Correct vertical position can be determined by timing and/or via a plurality of jack position sensor or sensing slots.

Once all chambers within a container are filled, the gates are closed and the filled container is removed. An empty container is then substituted and filled. The loaded chambers are then transferred to the end user, which may be in the same factory or plant as the manufacturer or may be a distant operation, where the filled container is again positioned onto a positioning table equipped for two dimensional movement. The individual chambers are then off-loaded one by one onto a feed hopper for an automatic letter stuffing machine or the like. For example, the envelopes can be pushed out of each chamber by a pneumatic ram aligned with the feed hopper. Off-loading of envelopes can be accomplished in reverse order of the loading, with alignment and chamber gate control accomplished in a similar fashion.

The empty containers can then be returned to the envelope manufacturer for reloading.

OBJECTS AND ADVANTAGES OF THE INVENTION

The principal objects of the present invention include: to provide an improved bulk envelope container apparatus and bulk envelope transfer system and method; to provide such a container in which a number of elongate chambers are provided, which may be arranged in rows and columns; to provide such a container in which each chamber includes an electromechanically controlled gate at one end thereof; to provide such a container which is positioned for automated loading or unloading on a positioning table which can selectively move the container horizontally and vertically; to provide such a container apparatus which is designed to cooperate with a loading apparatus for accumulating and propelling stacks of envelopes into chambers on the container and to cooperate with an unloading apparatus for unloading stacks of envelopes into a hopper for an automatic letter stuffer or the like; to provide such a loading apparatus which provides for alignment of each successive chamber with a loading surface; to provide such an unloading apparatus which provides for alignment of each successive chamber with the hopper; and to provide such a container, transfer system and method which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 9 is an enlarged, fragmentary cross-sectional view of the bulk container, taken along line 9—9 of FIG. 2, with portions of a gate motor housing broken away to illustrate the interior thereof and with a gate in the topmost chamber shown opened and with a gate in the bottommost chamber shown closed.

FIG. 10 is an enlarged, fragmentary front elevational view of the bulk container, with portions of a gate motor housing broken away to illustrate the interior thereof.

FIG. 11 is an enlarged, fragmentary side elevational view of the container and positioning table positioned adjacent to the exemplary envelope loading apparatus, and with envelopes accumulating behind the movable support.

FIG. 12 is an enlarged, fragmentary side elevational view of the container and positioning table positioned adjacent to the envelope loading apparatus of FIG. 11, and with first and second loading blade supports raised above the loading surface, and with the first blade support propelling the envelope stack to fill a chamber of the bulk container.

DETAILED DESCRIPTION OF THE INVENTION

Figure 1:
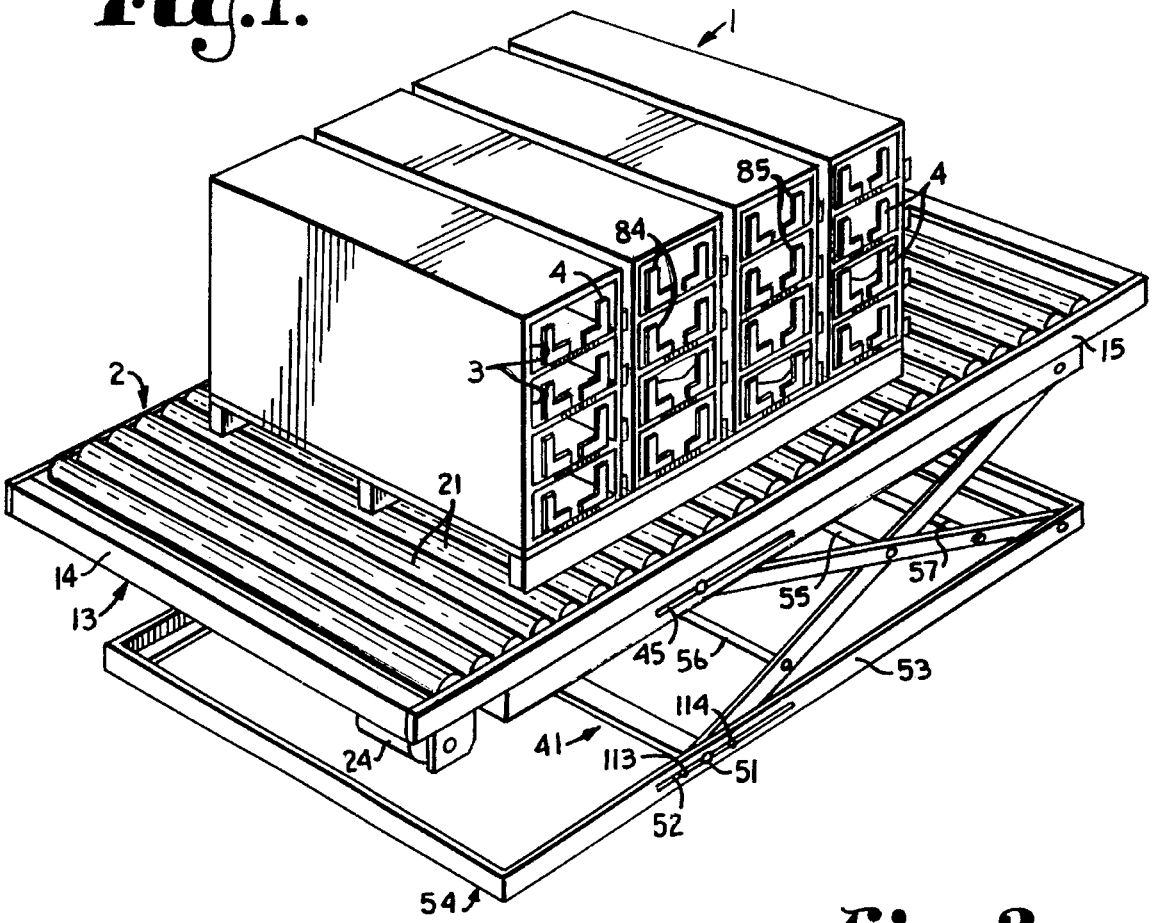
FIG. 1 is a perspective view of a bulk envelope container positioned on a positioning table in accordance with the present invention.
Figure 2:
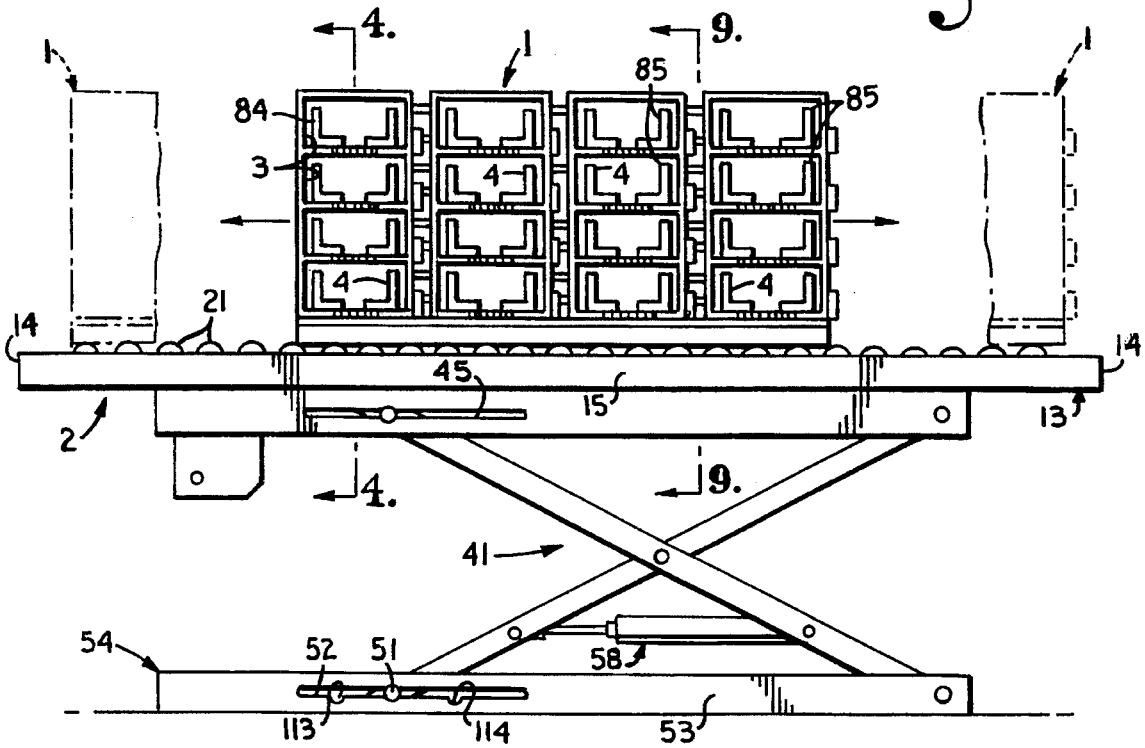
FIG. 2 is a front elevational view of the container and table of FIG. 1.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to FIGS. 1–4, a bulk envelope container 1 is shown atop a positioning table 2.

The container 1 includes a number of separate elongate chambers 3, each of which is equipped with a respective selectively and electromechanically operable gate 4 positioned at one end thereof. Each gate 4 is opened and closed by a respective reversible gate motor 5 (FIGS. 10 and 11). The motors 5 are selectively operated to turn a drive gear 11 which meshes with a gate gear 12 to pivot the associated gate 4 open or closed.

The positioning table 2 includes a rectangular top frame 13 including a pair of end frame members 14 and a pair of side frame members 15. A plurality of horizontal conveyor rollers 21 are rotatably connected between the side frame members 15.

Figure 3:
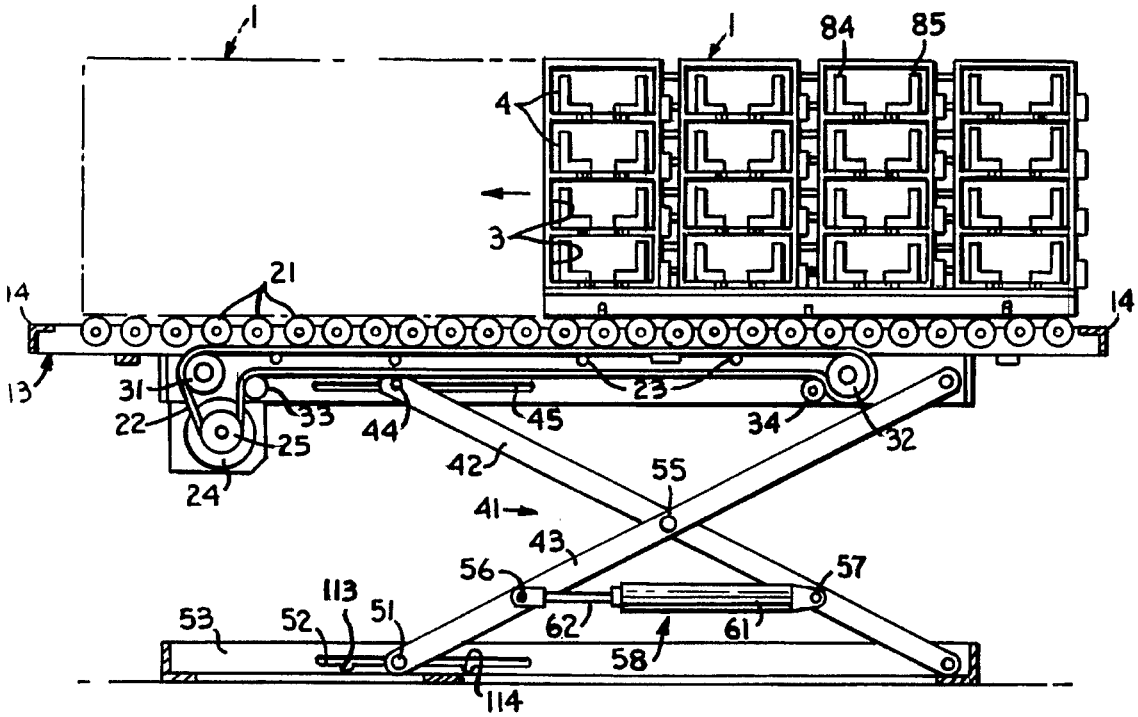
FIG. 3 is a front elevational view of the container and table of FIG. 1, with portions broken away to illustrate a horizontal roller conveyor which comprises the table surface, and with the container shown both in solid and phantom lines to indicate selective horizontal movement by the conveyor.
Figure 4:
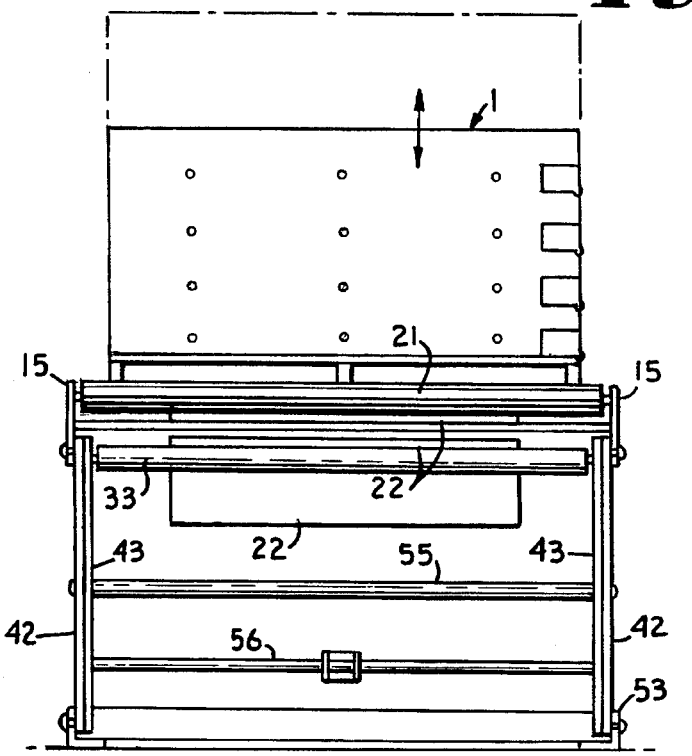
FIG. 4 is a cross-sectional view of the container and positioning table of FIG. 1, taken along line 4—4 of FIG. 1, and with the container shown both in solid and phantom lines to indicate selective vertical movement of the container via the positioning table.

Referring to FIG. 3, an endless conveyor belt 22 is held in contact with a number of the rollers 21 via a plurality of friction rollers 23. A reversible conveyor motor 24 drives the belt 22 via a drive pulley 25. The belt 22 encircles a pair of return pulleys 31 and 32 on either end of the belt loop and a pair of tensioning idler rollers 33 and 34. As illustrated in FIG. 3, when the motor 24 is rotating in either direction, the conveyor belt 22 is driven in the same direction. The belt 22 thus drives the conveyor rollers 21 in the opposite direction, causing the container 1 to be moved horizontally with the direction of movement of the topmost portion of the rollers 21.

Vertical movement of the container 1 is accomplished via a scissor jack 41, which includes two pairs of crossed support legs 42 and 43. The support legs 42 each include a pin 44 positioned near the top thereof, which pin 44 extends through a slot 45 in the conveyor top frame 13. Similarly, each leg 43 includes a pin 51 which extends through a slot 52 in a side frame member 53 of a rectangular bottom frame 54 of the table 2. The legs 42 and 43 on either side of the table 2 are pivotally connected to each other at a pivot point formed by a supporting cross member 55 which extends between the leg pairs 42 and 43 near the center of each leg. For stability, an additional pair of cross members 56 and 57 are connected between respective legs of each pair 42 and 43. A vertical positioning actuator 58, which is shown as a pneumatic cylinder 61 with a telescoping rod 62, is attached between the two cross members 56 and 57 beneath the top frame 13 of the table 2. As the telescoping rod 62 is extended, the upper frame 13 is raised, and, conversely, as the rod 62 is retracted, the upper frame 13 is lowered. Of course, the container 1 is thus raised and lowered as well. A motorized jackscrew can be substituted for the pneumatic cylinder 61.

Exemplary Envelope Loading Apparatus And Method

Figure 5:
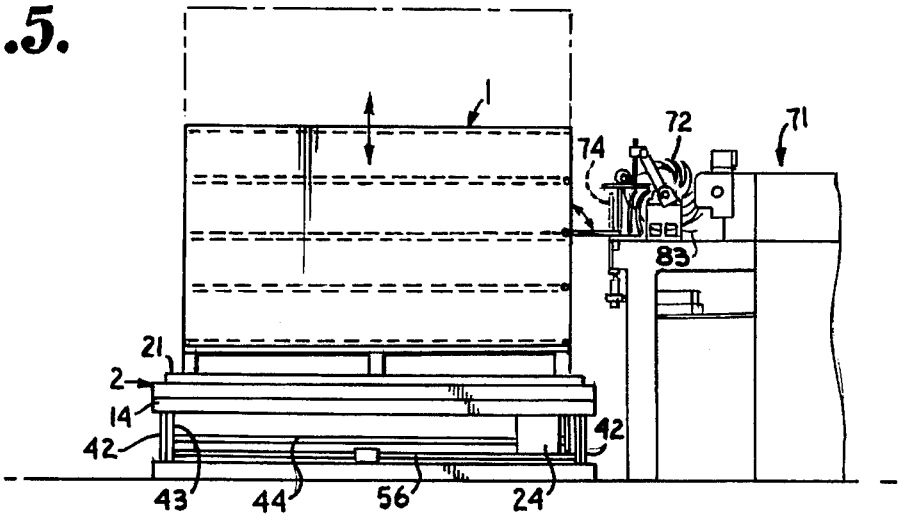
FIG. 5 is a reduced, fragmentary side elevational view of the container and positioning table positioned adjacent to an exemplary envelope loading apparatus, with individual chambers shown in phantom lines, and with selective vertical movement of the container again indicated by solid and phantom lines.
Figure 6:
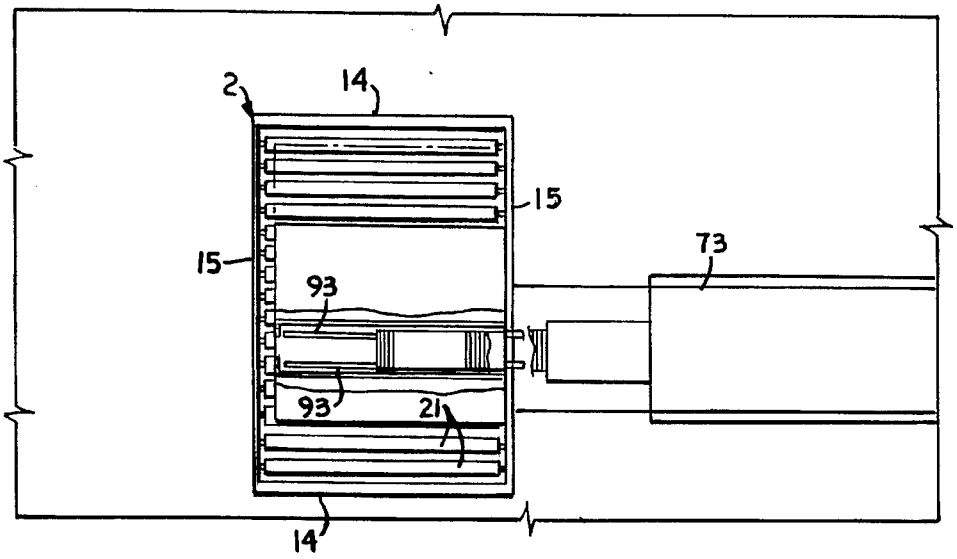
FIG. 6 is a reduced, fragmentary top plan view of the container, positioning table and loading apparatus of FIG. 5, showing a chamber partially filled and a movable spring loaded support being pushed backward by the accumulating envelopes.
Figure 7:
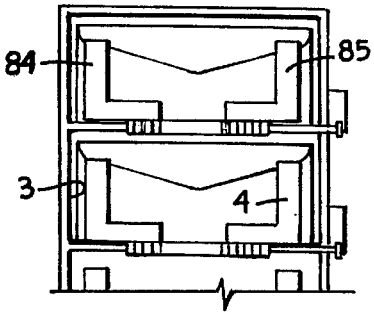
FIG. 7 is an enlarged, fragmentary rear view of two chambers in the bulk container, illustrating the spring loaded movable support.
Figure 8:
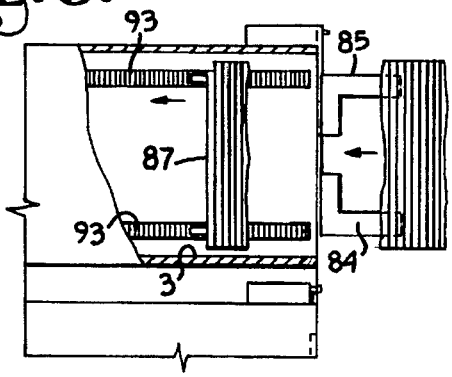
FIG. 8 is an enlarged, fragmentary top plan view of a chamber within the bulk container, with portions broken away to illustrate the accumulation of a stack of envelopes therein and with the movable spring loaded support being pushed backward.

Referring to FIGS. 5–8, 11 and 12, the container 1 and positioning table 2 is shown positioned adjacent to an envelope manufacturing machine 71. The illustrated machine 71 includes a conventional delivery spider 72 which accepts completed envelopes from the machine 71 and delivers them in an upright position onto a horizontal loading surface 73. A pair of blade supports 74 and 75 are each selectively raised and lowered by adjacent respective vertically oriented pneumatic cylinders 80 and 81. Similarly, the blade supports 74 and 75 are laterally movable via a respective pair of horizontally oriented pneumatic cylinders 82, of which one is shown in FIGS. 5 and 11.

Figure 13:
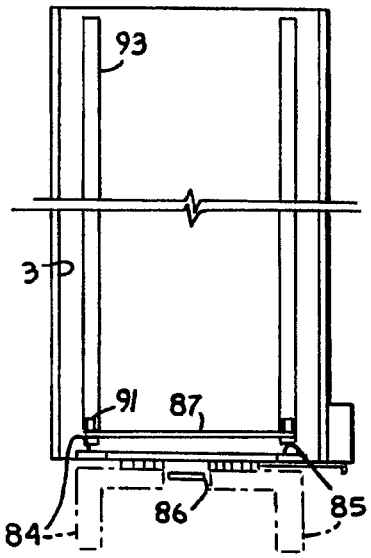
FIG. 13 is an enlarged, fragmentary top plan view of a chamber within the bulk container, illustrating a gate opened on one end in phantom lines and closed in solid lines.

Referring to FIG. 5, envelopes 83, which are shown being delivered onto the loading surface 73, are accumulated behind the first blade support 74, which has been raised into the position shown by the pneumatic cylinder 80. Referring to FIG. 11, as the stack of envelopes grows, the first blade support 74 is moved laterally to the left via one of the cylinders 82 at the rate of accumulation of the envelopes 83, and the envelopes 83 thus extend over the opened gate 4. Each gate 4 is shaped as a fork with two tines 84 and 85. Referring to FIG. 13, the first blade support 74 comprises a single narrow blade 86 centered between the tines 84 and 85. Thus, when the chamber 3 is full, the gate 4 can be closed even with the blade 86 holding the envelope stack upright.

As the lead envelope 83 reaches the edge of the aligned chamber 3, it encounters a spring loaded and ratcheted support member 87. At this point, the first blade support 74 is dropped down between the tines 84 and 85 and returned laterally to the right to its original position.

The support member 87 is held upright by a coil spring 88, and includes a ratchet engaging finger 91 which engages a ratchet 92 extending along the floor of each chamber 3. The support member 87 is movable along a track 93 (FIG. 6) placed on either side of the ratchet 92. As the envelopes 83 accumulate, they exert pressure on the support member 87, which rotates against the action of the spring 88, causing the finger 91 to temporarily disengage from the teeth of the ratchet 92 and allowing the finger 91 to slide backward along the track 93. This process is repeated continuously as the envelopes 83 accumulate until the support member 87 reaches the end of the chamber 3.

Referring again to FIGS. 11 and 12, the first and second blade supports 74 and 75 cooperate such that the first blade support 74 pushes the envelope stack into the aligned chamber 3 as the second support 75 allows additional envelopes 83 to accumulate behind it.

Envelope Loading Operation

Figure 15:
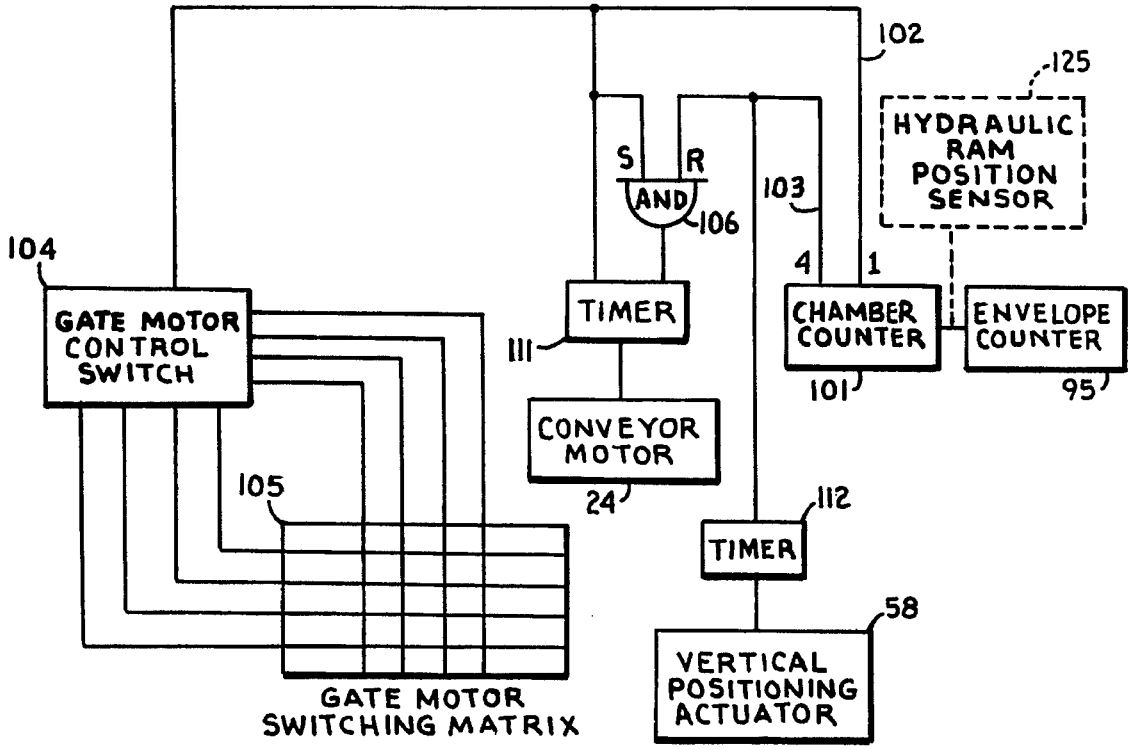
FIG. 15 is a schematic electrical block diagram of a container positioning timing and logic switching control circuit.

Referring to FIGS. 11, 12 and 15, the envelope loading steps are repeated until an envelope counter 95 (shown schematically in FIG. 15) triggers a chamber counter 101. The chamber counter outputs a control signal on a line 102 each time it receives a signal from the counter 95, and which also outputs a control signal on a line 103 each time it counts four signals from the counter 95. The signals on line 102 serve to sequence a gate motor control switch 104 to control the closing of the aligned gate 4 and the opening of the gate 4 associated with the next chamber 3 via a gate motor switching matrix 105. The signals on line 102 also provide one input of an AND gate 106 and are also directly sent to a timer 111 which sends a timed signal to enable the conveyor motor 24 for a predetermined period sufficient to enable the conveyor rollers 21 to shift the container 1 horizontally to align the next chamber 3 with the loading surface 73. The signals on the line 103, which occur with the loading of the fourth chamber 3 in each row, are sent to the second input of the AND gate 106 and to a timer 112 which controls the conveyor vertical positioning actuator 58. Thus, when signals are present on both lines 102 and 103, the AND gate 106 sends a high output to the reset input of the timer 111 to prevent the sending of a timed signal to the motor 24, thus keeping the container 1 in its current horizontal position. Simultaneously a timed control signal is output from the timer 112 to the actuator 58 to raise (or lower) the container 1 so that the next row of chambers 3 are aligned with the loading surface 73. A pair of detents 113 and 114 (FIG. 3) are positioned in the slot 52 to insure the vertical alignment of the container 1 in each intermediate position, with the ends of the slot 52 controlling vertical alignment in the top and bottom row positions.

Each horizontal or vertical adjustment of the container 1 by the positioning table 2 can be accomplished in the time it takes for the first blade support 74 to be lowered and returned rightward to its original position and then raised and pushed leftward to begin loading the next envelope stack.

The gate motor control switch 104 can be an electromechanical rotary sequencing switch with alternating contacts for each gate motor 5 to alternately open and close the associated gates 4. Alternatively the counter 101, the gate control switch 104, the AND gate 106, and the timers 111 and 112 can be replaced by programmed functions of a programmable controller.

Envelope Unloading

Figure 14:
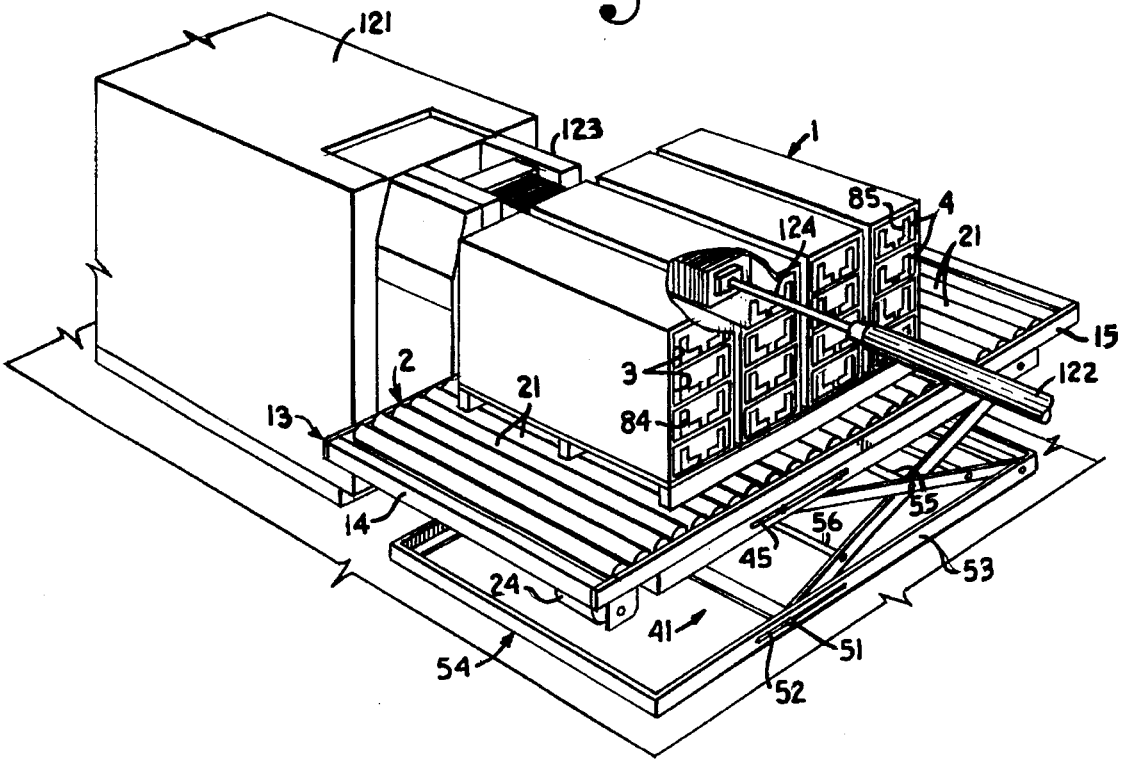
FIG. 14 is a perspective view of the bulk container positioned on a positioning table adjacent an stuffing machine, with envelopes being off-loaded from a chamber therein via a pneumatic ram.

Referring to FIG. 14, the container 1 and positioning table 2 are shown positioned adjacent to a machine 121, which may be, for example, an automatic letter stuffer for inserting letters in envelopes. A pneumatic ram 122 is shown positioned on the opposite side of the container 1 from an envelope hopper 123 in the stuffer 121. An extendable piston 124 is inserted in the end of the aligned chamber 3 opposite the gate 4 to force the envelopes 83 past the opened gate 4 and into the hopper 123. When the aligned chamber 3 is emptied of envelopes 83, the positioning table 2 is used to move the container 1 such that the next chamber 3 is aligned between the hopper 123 and the ram 122. Positioning and gate sequencing can be accomplished in a similar fashion as shown in FIG. 15, except that the triggering signal on line 102 would come not from an envelope counter 95, but from a pneumatic ram position sensor 125, as shown in phantom lines in FIG. 15. In other words, each time the piston 124 is retracted, a signal is sent on line 102 by the position sensor 125 and the positioning table 2 is controlled to align the next chamber 3 as the correct gate 4 is opened by the gate control switch 104 in essentially the same manner as in the loading operation described earlier.

While certain loading and unloading apparatuses and sequencing techniques have been illustrated and described, it should be clear that other loading and unloading devices and techniques could be equally useful with the container 1 and positioning table 2. Furthermore, instead of motor controlled gates, each chamber 3 could be equipped with a spring loaded gate or similar closure which would fold down for loading and automatically spring up into blocking position once sufficient envelopes 83 were loaded into the associated chamber 3. Even though a container 1 which includes four rows each with four chambers 3 has been illustrated, any desired number and arrangement of chambers can be used, including a single row such that vertical adjustment of the positioning table 2 is unnecessary. The control system of FIG. 15 has been shown and described as a time based system, however, it should be noted that a position base system, including position detectors such as photosensors, could be used to synchronize the positioning table with the loading and unloading apparatuses.

It is to be understood that while certain forms of the present invention have been illustrated and described herein, it is not to be limited to the specific forms or arrangement of parts described and shown.

What is claimed and desired to be secured by Letters Patent is as follows:

1. A bulk container apparatus for holding a plurality of envelopes, comprising:

(a) a plurality of elongate chambers arranged in rows and columns, with each chamber sized to accommodate a plurality of said envelopes;

(b) a plurality of gates with each said gate attached to one end of a respective chamber with each said gate selectively opening or closing the associated chamber;

(c) an electromechanical operator attached to each said gate for selectively opening and closing the associated gate;

(d) control means for selectively, sequentially controlling each of said electromechanical operators to sequence said gates for loading or unloading; and (e) movable support means within each said chamber for holding said envelopes in an upright position, each said movable support means including support member held upright by a spring and a ratchet extending along each said chamber for incrementally engaging the respective support member as it advances along the chamber.

2. In a system for transferring a plurality of items from a loading station to an unloading station, transfer means comprising:

(a) a bulk container including a plurality of elongate chambers arranged in rows and columns;

(b) positioning means for selectively moving said bulk container horizontally and vertically to loading or unloading positions such that at least one of said chambers is aligned with said loading or unloading station, respectively;

(c) control means for controlling said positioning means to selectively and sequentially position said chambers to said loading or unloading positions;

(d) a gate positioned at the end of each said chamber: and (e) electromechanical gate operating means for each said gate for individually and Selectively moving the associated gate between open and closed positions.

3. In a system as in claim 2, said positioning means comprising:

(a) bidirectional conveyor means for selectively moving said container horizontally.

4. In a system as in claim 3, said bidirectional conveyor means comprising:

(a) a bidirectional motor;

(b) an endless belt coupled to said bidirectional motor; and (c) a plurality of conveyor rollers which are engaged by said belt to move said container horizontally.

5. In a system as in claim 3, said positioning means further comprising:

(a) bidirectional vertical adjustment means for selectively moving said container vertically.

6. In a system as in claim 5, said bidirectional vertical adjustment means comprising:

(a) a scissors jack supporting said conveyor means; and (b) actuator means for selectively raising and lowering said scissors jack to thereby raise and lower said conveyor means.

7. In a system as in claim 6, said actuator means comprising:

(a) pneumatic cylinder means connected between two spaced legs of said scissors jack to selectively expand or contract the spacing between said legs to thereby raise or lower, respectively, said jack.

8. In a system as in claim 6, wherein:

(a) said items are envelopes and said container is a bulk envelope container.

9. In a system as in claim 8, wherein:

(a) said loading station is an envelope manufacturing facility with a loading apparatus for loading finished envelopes into said container.

10. In a system as in claim 9, wherein:

(a) said unloading station is an envelope end user facility with an unloading apparatus for unloading said envelopes from said container.

11. In a system as in claim 10, wherein:

(a) said control means is interfaced with said envelope unloading apparatus to synchronize the positioning of said container chambers dependent upon a receiving condition of said unloading apparatus.

12. In a system as in claim 10, wherein:

(a) said control means is interfaced with said envelope loading apparatus to synchronize the positioning of said container chambers dependent upon a dispensing condition of said loading apparatus.

13. In a system as in claim 2, wherein:

(a) said control means is interfaced with said unloading station and said electromechanically controlled gates to synchronize the positioning of said container chambers and the opening and closing of said gates dependent upon a receiving condition of said unloading station.

14. In a system as in claim 2, wherein:

(a) said control means is interfaced with said loading station and said electromechanically controlled gates to synchronize the positioning of said container chambers and the opening and closing of said gates dependent upon a dispensing condition of said loading station.

15. In a system for transferring a plurality of envelopes in bulk from an envelope loading apparatus to an envelope unloading apparatus, envelope transfer means comprising:

(a) a bulk container including a plurality of elongate chambers arrayed in rows and columns;

(b) positioning table means for selectively moving said bulk container vertically and horizontally to a position such that at least one of said chambers is aligned with said loading apparatus or unloading apparatus;

(c) a plurality of gates with each said gate positioned at the end of a respective one of said chambers, each said gate being individually and selectively movable between open and closed positions; and (d) control means for controlling said positioning means to selectively and sequentially position said chambers and to synchronize the opening and closing of said gates to correspond with a dispensing condition of said loading apparatus or a receiving condition of said unloading apparatus.

16. In a system as in claim 15, said positioning table including a bidirectional conveyor means comprising:

(a) a bidirectional motor;

(b) an endless belt coupled to said bidirectional motor; and (c) a plurality of conveyor rollers which are engaged by said belt to move said container horizontally.

17. In a system as in claim 16, said positioning table means further comprising bidirectional vertical adjustment means for selectively moving said container vertically, said vertical adjustment means comprising:

(a) a scissors jack supporting said conveyor means; and (b) actuator means for selectively raising and lowering said scissors jack to thereby raise and lower said conveyor means.

18. In a system as in claim 15, said bulk container apparatus further comprising:

(a) movable support means within each said chamber for holding said envelopes in an upright position as they are loaded or unloaded.

19. A method of transferring a plurality of envelopes in bulk from a loading station to an unloading station, the method comprising:

(a) providing a bulk container including a plurality of elongate chambers arranged in rows and columns with each said chamber accommodating a plurality of said envelopes and with each said chamber including an individual gate movable between open and closed positions;

(b) selectively positioning said container proximate said loading station such that said chambers are successively aligned with said loading station by selectively moving said container in both vertical and horizontal directions;

(c) selectively opening the gate associated with the aligned chamber;

(d) loading said envelopes into each of said bulk container chambers as they are aligned with said loading station;

(e) closing the gate associated with the aligned chamber; and (f) transferring said bulk container to said unloading station.

20. A method as in claim 19, and further comprising the steps of:

(a) selectively positioning said container proximate said unloading station such that said chambers are successively aligned with said unloading station by selectively moving said container in both vertical and horizontal directions; and (c) unloading said envelopes from each of said bulk container chambers as they are aligned with said unloading station.

21. A method as in claim 19, wherein said selectively positioning step comprises:

(a) moving said container in synchronism with said loading station such that said container is moved to align a subsequent chamber only when the currently aligned chamber is filled.

22. In a system for transferring a plurality of items from a loading station to an unloading station, transfer means comprising:

(a) a bulk container including a plurality of elongate chambers arranged in rows and columns;

(b) positioning means for selectively moving said bulk container horizontally and vertically to loading or unloading positions such that at least one of said chambers is aligned with said loading or unloading station, respectively for loading or unloading;

(c) control means for controlling said positioning means to selectively and sequentially position said chambers;

(d) electromechanically controlled gates respectively positioned at the end of each said chamber, each said gate being individually and selectively movable to an open or a closed position; and (e) control means interfaced with said loading station and said electromechanically controlled gates to synchronize the positioning of said container chambers and the opening and closing of said gates dependent upon a receiving condition of said unloading station.

23. In a system as in claim 22, said transfer means further comprising:

(a) synchronizing means for said control means, said unloading station and said electromechanically controlled gates to synchronize the positioning of said container chambers and the opening and closing of said gates dependent upon a dispensing condition of said loading station.

* * * * *